US007520961B2

(12) United States Patent
Glawogger et al.

(10) Patent No.: US 7,520,961 B2
(45) Date of Patent: Apr. 21, 2009

(54) PROCESS AND DEVICE FOR BLENDING FLUID FLOWS

(75) Inventors: Josef Glawogger, St. Oswald b. (AT); Erich Harzl, Graz (AT)

(73) Assignee: Andritz AG, Graz (AT)

( * ) Notice: Subject to any disclaimer, the term of this patent is extended or adjusted under 35 U.S.C. 154(b) by 401 days.

(21) Appl. No.: 11/128,605

(22) Filed: May 13, 2005

(65) Prior Publication Data

US 2005/0269051 A1 Dec. 8, 2005

(30) Foreign Application Priority Data

May 13, 2004 (AT) ..... A 830/2004

(51) Int. Cl.
*D21F 11/00* (2006.01)

(52) U.S. Cl. ..... 162/216; 162/212; 162/315

(58) Field of Classification Search ..... 162/212, 162/216, 315, 253, 258, 259, 263, DIG. 6, 162/183, 141, 202
See application file for complete search history.

(56) References Cited

U.S. PATENT DOCUMENTS

| | | | | |
|---|---|---|---|---|
| 4,219,340 | A | 8/1980 | Kaiser | 55/41 |
| 4,676,809 | A | 6/1987 | Fjällström et al. | 55/204 |
| 6,203,667 | B1 * | 3/2001 | Huhtelin | 162/253 |
| 6,267,845 | B1 * | 7/2001 | Hautala et al. | 162/183 |
| 6,440,272 | B1 * | 8/2002 | Binder et al. | 162/261 |
| 6,551,459 | B1 * | 4/2003 | Lumiala et al. | 162/198 |
| 2002/0060026 | A1 * | 5/2002 | Huovila et al. | 162/258 |

FOREIGN PATENT DOCUMENTS

| | | | |
|---|---|---|---|
| DE | 203 16 687 | | 3/2004 |
| EP | 0543866 | | 6/1993 |
| EP | 1347094 | * | 9/2003 |
| WO | WO 92/03613 | * | 3/1992 |
| WO | WO 95/10350 | | 4/1995 |

OTHER PUBLICATIONS

European Search Report EP 05 00 9018, dated Sep. 8, 2005.

* cited by examiner

*Primary Examiner*—Mark Halpern
(74) *Attorney, Agent, or Firm*—Alix, Yale & Ristas, LLP

(57) ABSTRACT

The invention relates to a process for blending liquid flows, particularly in the approach system to a paper machine. It is characterized by the individual liquid flows being merged, blended with one another, and degassed, all at the same time. In addition, the invention relates to a device for implementing the process, where a degassing device 5, particularly a rotor with degassing holes, is provided in a mixing pipe 1.

15 Claims, 6 Drawing Sheets

PROCESS AND DEVICE FOR BLENDING FLUID FLOWS

BACKGROUND

The invention relates to a process for blending liquid flows, particularly in the approach system to a paper machine, as well as a device for implementing the process.

In paper-making, a pulp suspension is distributed evenly over a wire and the greater part of the water is removed from the pulp in the first part. Before the suspension is fed onto the wire, impurities, in particular, are removed. The pulp suspension also contains gas, particularly air, as free air in the form of bubbles and as dissolved air. This air, especially in the form of bubbles, causes problems in the paper production process, particularly if present in larger quantities. As a result there may be problems with foam, instabilities in the process, pulsations in the approach system to the paper machine, reduced dewatering performance and, as a further consequence, small holes may appear in the paper web.

A process to achieve maximum possible degassing is described, for example, in U.S. Pat. No. 4,219,340. The evacuation is, however, very complex and in many cases, there is no need for complete evacuation.

In the approach system to the paper machine, different pulp components (long fibres, short fibres, broke, etc.) are currently fed into a tank and blended. The various chemicals are added (e.g. wet strength agent, dye, filler, etc.). As an alternative, the individual components and also additives can be fed into a mixing pipe.

The problem with these set-ups is that the substances are not mixed adequately and also contain a large proportion of gas, both in the individual flows of the pulp components and in the white water. EP 0 543 866 B1 shows a plant, for example, in which several pumps are used to remove the gas from the pulp that has been blended beforehand and from the white water coming from the paper machine. The plant is not capable, however, of mixing pulp components and additives.

Although the sensors for measuring quantities and consistency are located in the de-aerated pulp, there is no device here to mix the dilution water homogenously into the pulp.

SUMMARY

The present invention is intended to prevent these disadvantages and is thus characterized by the individual liquid flows being merged, blended with one another, and degassed, all at the same time. Since the mixture is degassed at the same time, a constant status is achieved after blending, which means it is possible to do without the large mixing tanks needed hitherto. In addition, it is possible to obtain exact measurements of the pulp data, particularly the consistency.

It is a particular advantage if individual liquid components are blended with one another, during which process additives can also be mixed into the pulp as this produces a homogenous pulp suspension from which also a homogenous paper web can be produced.

It has proved favourable to blend dilution water, e.g. white water from a paper machine, into the individual liquid flows, where the entire white water can also be mixed into the suspension. When the pulp components are blended with the white water, the white water can then also be de-aerated together with the suspension. Thus, a level of de-aerating can be achieved in many cases that renders complex vacuum de-aerating unnecessary.

An advantageous configuration of the invention is characterized by the blended and degassed suspension being fed to a storage tank, e.g. machine chest, standpipe. With this storage tank it is possible to obtain a yet more uniform suspension and particularly, to eliminate any pulsations, however it is important to have a small volume so that any grade or colour change can be carried out promptly. As the suspension has been well blended beforehand, there is no longer any need for the mixing chest required previously.

Particularly low volumes and thus, particularly favourable grade changes, are obtained if the blended and degassed suspension is fed directly to a pump.

A favourable further development of the invention is characterised by at least one characteristic value of the suspension being measured after blending and degassing, where the consistency of the pulp suspension can be measured and, advantageously, the dilution water is added according to the consistency of the blended and degassed pulp suspension. Since the dilution water is mixed in well, it is also possible to obtain high accuracy. Other pulp data, however, such as ash content, brightness, or freeness, can also be measured online with particular accuracy.

The invention also relates to a device for blending liquid flows, particularly in the approach system to a paper machine. According to the invention, this is characterized by a degassing device, particularly a rotor with degassing holes, being provided in a mixing pipe. In this way, the pulp suspension can be blended particularly well, and degassed at the same time.

An advantageous further development of the invention is characterized by several pipes for liquid flows, particularly pulp components, leading into the mixing pipe, into which a dilution water pipe can also discharge. As a result, the consistency of the pulp suspension especially can be regulated particularly well to the desired value. Blending and homogenising is much more intensive here compared to a mixing chest.

A particularly favourable embodiment of the invention is characterized by the white water pipe of a paper machine discharging into the mixing pipe. Thus, the entire white water can also be degassed together with the liquids added, particularly pulp components.

A favourable variant of the invention is characterized by the mixing pipe being connected to a storage tank after the degassing device, where this storage tank can be designed as a standpipe. Here, the standpipe together with the white water tank can form a communicating vessel, which makes the system self-regulating.

An alternative advantageous embodiment of the invention is characterised by the mixing pipe being connected to a pump after the degassing device. This results in particularly low storage volumes and thus, a particularly favourable means of changing the grade or colour of paper produced.

An advantageous embodiment of the invention is characterized by a measuring device for at least one of the suspension's characteristic values being provided after the degassing device, where the measuring device can be a consistency meter and where it is an advantage if this consistency meter is connected to a valve in the dilution water pipe via a controller. In this way, the consistency of the pulp suspension can e set particularly accurately in the feed to the paper machine. In addition, other measuring devices, e.g. for brightness, ash content or freeness, can be used and will provide particularly accurate measuring values, especially on account of the virtually gas-free and homogenous suspension.

BRIEF DESCRIPTION OF THE DRAWINGS

The invention will now be described in examples and referring to the drawings, where.

DETAILED DESCRIPTION

Figure 1:
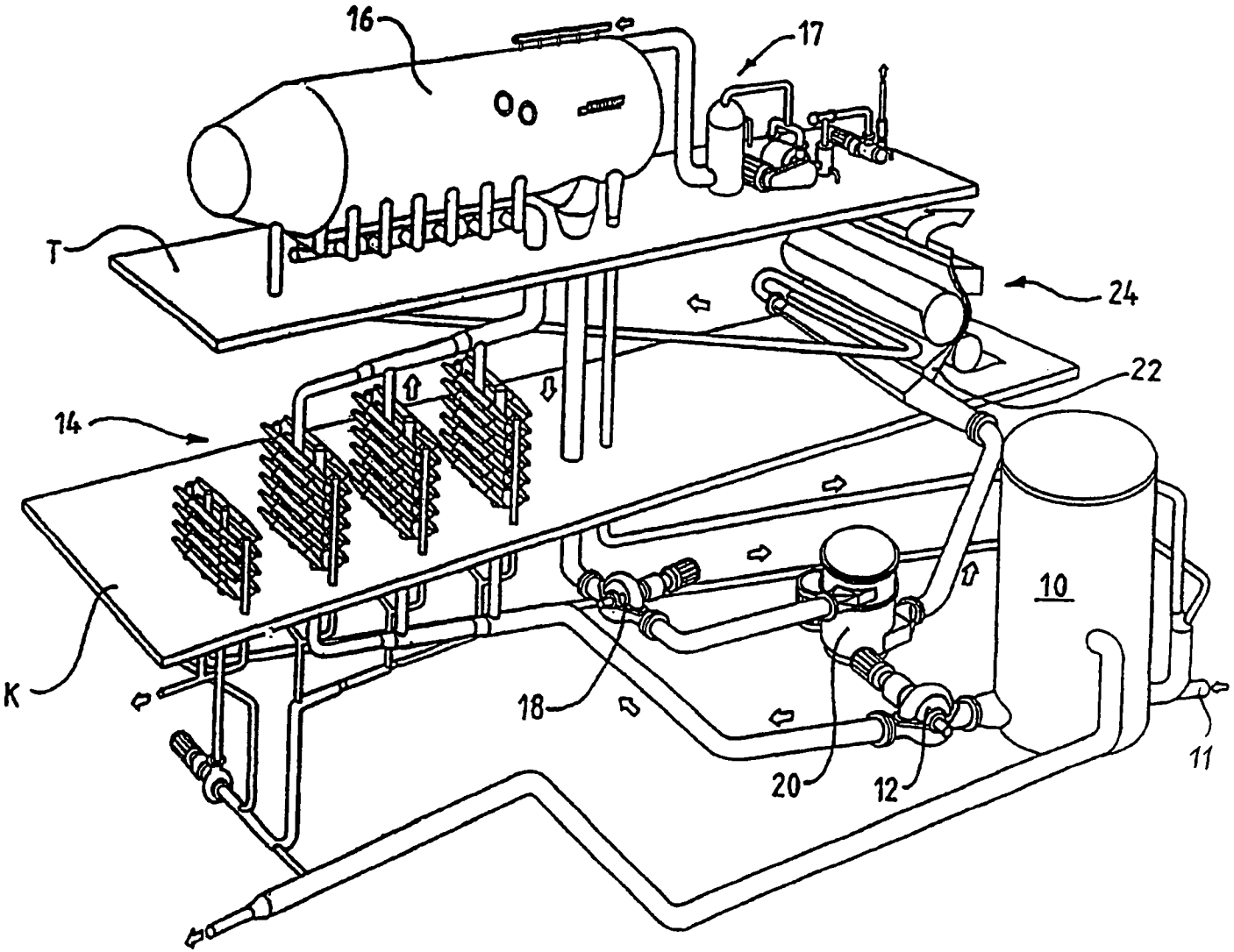
FIG. 1 shows a state-or-the-art plant, FIG. 2 contains a diagram of a variant of the invention.

According to the state of the art, the approach system to a paper machine shown in FIG. 1, also known as the supply system, incorporates a white water tank 10, a feed pump 12, a centrifugal cleaner 14, a gas separation tank 16 with its vacuum device 17, a headbox pump 18, a screen 20, a headbox 22 for the paper machine, and white water collecting troughs (not shown). Pulp components used in paper-making, e.g. virgin pulp, recycled fibres and/or broke, and fillers, that are diluted together with the white water obtained from the wire section of the paper machine 24, are brought through a pipe 11 to the white water tank 10 where all of the white water from the paper machine is collected. The pulp suspension is pumped from the white water tank 10 to the centrifugal cleaner 14 by a feed pump 12. The accept pulp from the first stage of the centrifugal cleaner 14 is carried into the gas separation tank 16 by the pressure generated by the feed pump, assisted by the vacuum prevailing in this tank. From the gas separation tank 16, the largely gas-free pulp suspension, from which the gas has been removed entirely if possible by the vacuum device 17, flows to a fan pump 18 that pumps the pulp suspension to the screen 20, from where the accept pulp flows into the headbox 22 of the paper machine 24. The gas separation tank 16 is located typically on a level T above the machine level K.

Figure 2:
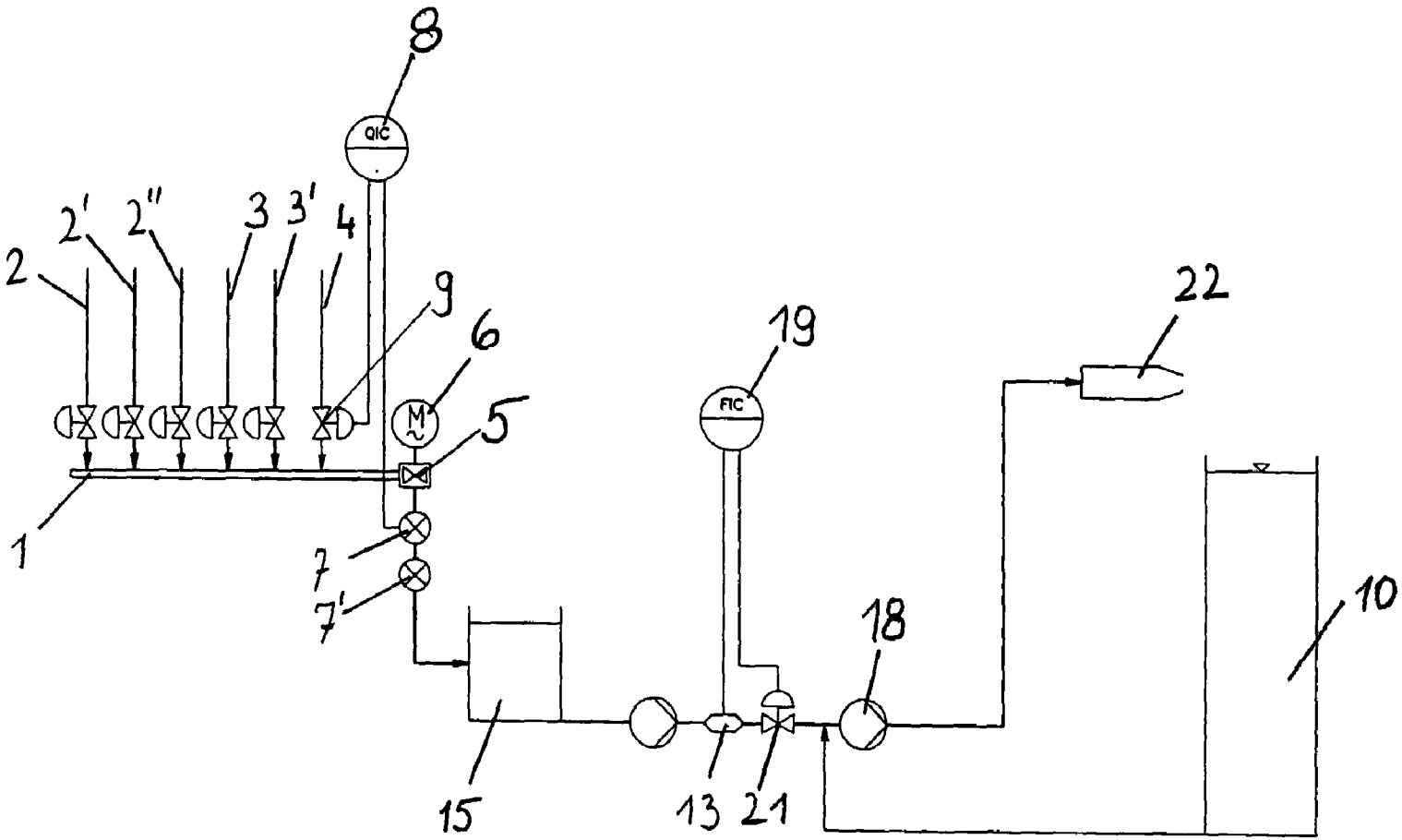

FIG. 2 shows the diagram of a plant according to the invention. Various liquid components are fed to a mixing pipe 1 through pipework 2, 2', 2", where these components can be, for example, virgin pulp, recycled fibres and/or broke. Furthermore, pipework 3, 3' that discharges into the mixing pipe 1 is provided for additives, such as dyes, fillers, etc. Dilution water is added through pipe 4, where this can be part of the white water or clear filtrate from a disc filter. When all pulp and additives have been added, the suspension is blended by a degassing rotor 5 with drive motor 6 and degassed at the same time. The consistency of the blended and degassed pulp suspension is determined using a consistency meter 7 and the flow control valve 9 in the dilution water pipe 4 is regulated by a control device 8. Further measuring devices 7', e.g. for ash content, brightness, or freeness, can be located after the degassing rotor 5, providing very exact measurements thanks to the degassing process. The blended and degassed pulp suspension then enters a machine chest 15. The degassing rotor 5 causes a pressure build-up which is compensated by the height of the tank in such a way that the mixing pipe 1 has approximately atmospheric pressure. This is important because a large part of the gas and air is then present here in the form of bubbles and can be removed very easily by the degassing rotor 5. After the machine chest 15 there is a flow meter 13 that controls a flow control valve 21 via flow regulator 19. Controlling the rate of flow can only be achieved effectively if a constant pulp consistency is assured and if the consistency matches the planned value. By using the control system proposed, this can be guaranteed. After the flow meter 13, the pulp suspension is fed through a headbox pump 18 to the paper machine headbox 22.

Figure 3:
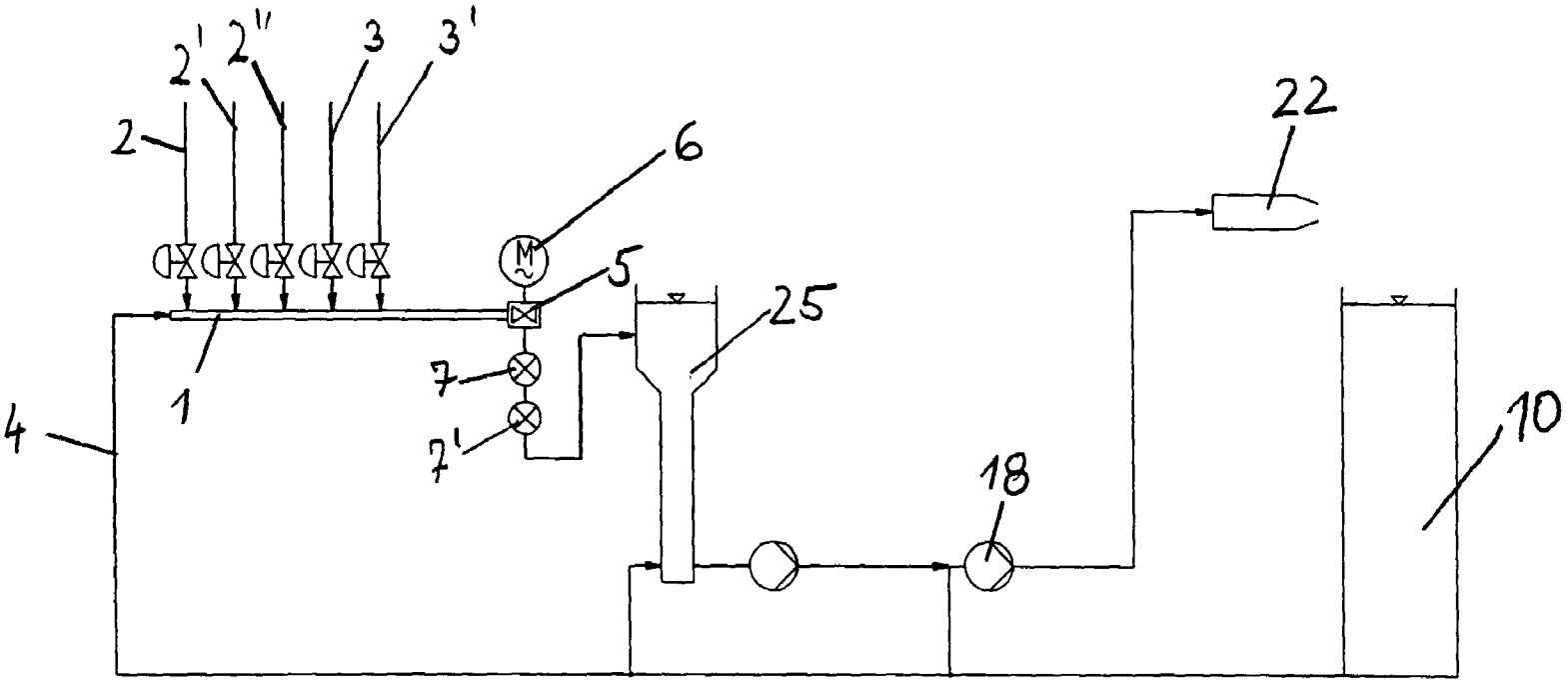
FIG. 3 shows a further variant of the invention, FIG. 4 another variant of the invention, FIG. 5 an embodiment of the invention, and FIG. 6 a further embodiment of the invention.

FIG. 3 shows a variant of the invention with a standpipe 25 that is used in place of the machine chest 15. Together with the white water tank 10, this standpipe 25 forms a system of communicating vessels, where the liquid surfaces in the standpipe 25 and the white water tank 10 are on the same level. This creates a self-regulating effect for the feed. Part of the white water is used here as dilution water 4.

Figure 4:
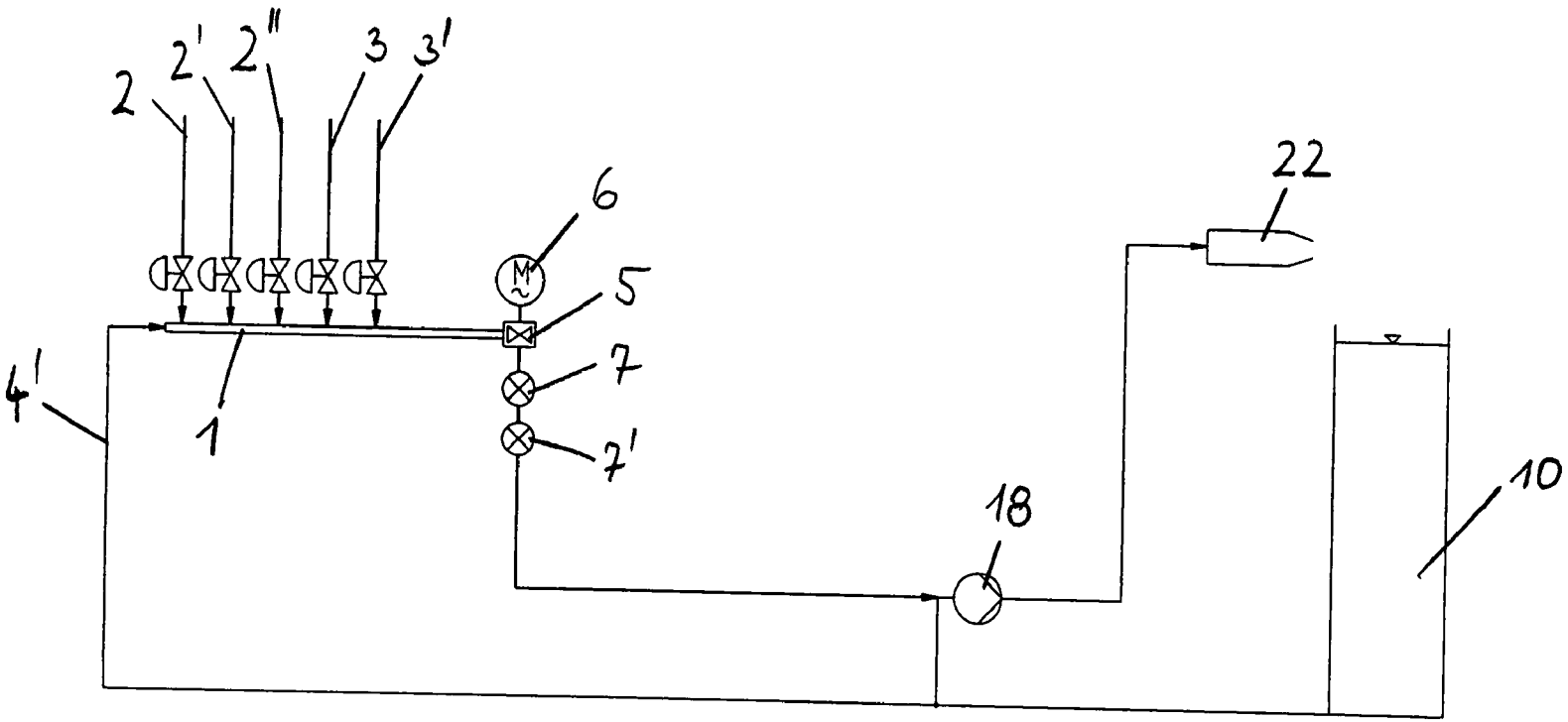

FIG. 4 shows a similar variant, where virtually all of the white water 4' here is fed into the mixing pipe 1 on the one hand, and the blended and degassed suspension is then brought directly to the headbox pump 18. As a result, the storage volume of the plant is kept to a minimum and changes of colour and/or grade can be carried out within a very short time.

Figure 5:
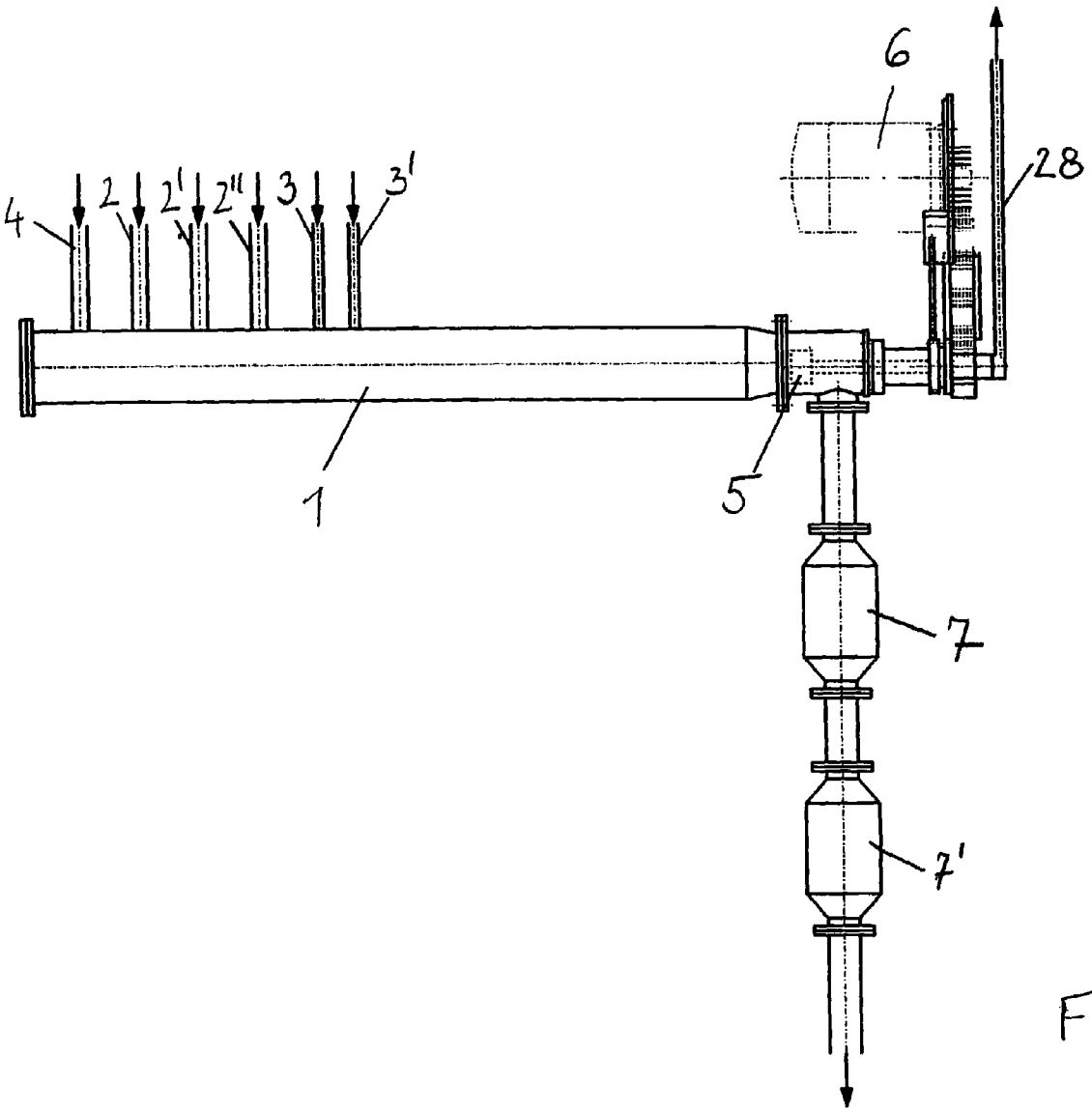

FIG. 5 provides a detailed illustration of a blending and degassing device according to the invention, where this variant has a mixing pipe 1 into which a pipe 4 discharges white water. Several pipes 2, 2', 2" for supplying different liquid components lead into the mixing pipe 1. In addition, pipes 3, 3' are provided to supply various additives. The air extracted from the degassing rotor 5 is carried off through a pipe 28. The degassing rotor 5 is driven by a drive 6. After the degassing rotor 5, measuring units 7 are provided to measure consistency and 7' to measure other pulp data, such as ash content, brightness, and freeness. The blended and degassed suspension is fed through a pipe to a tank (chest) or to a feed pump to the headbox of a paper machine. With a suitable embodiment of the degassing rotor 5, the suspension can be brought directly into a tank without any additional pump, with the rotor 5 providing sufficient pressure differential.

Figure 6:
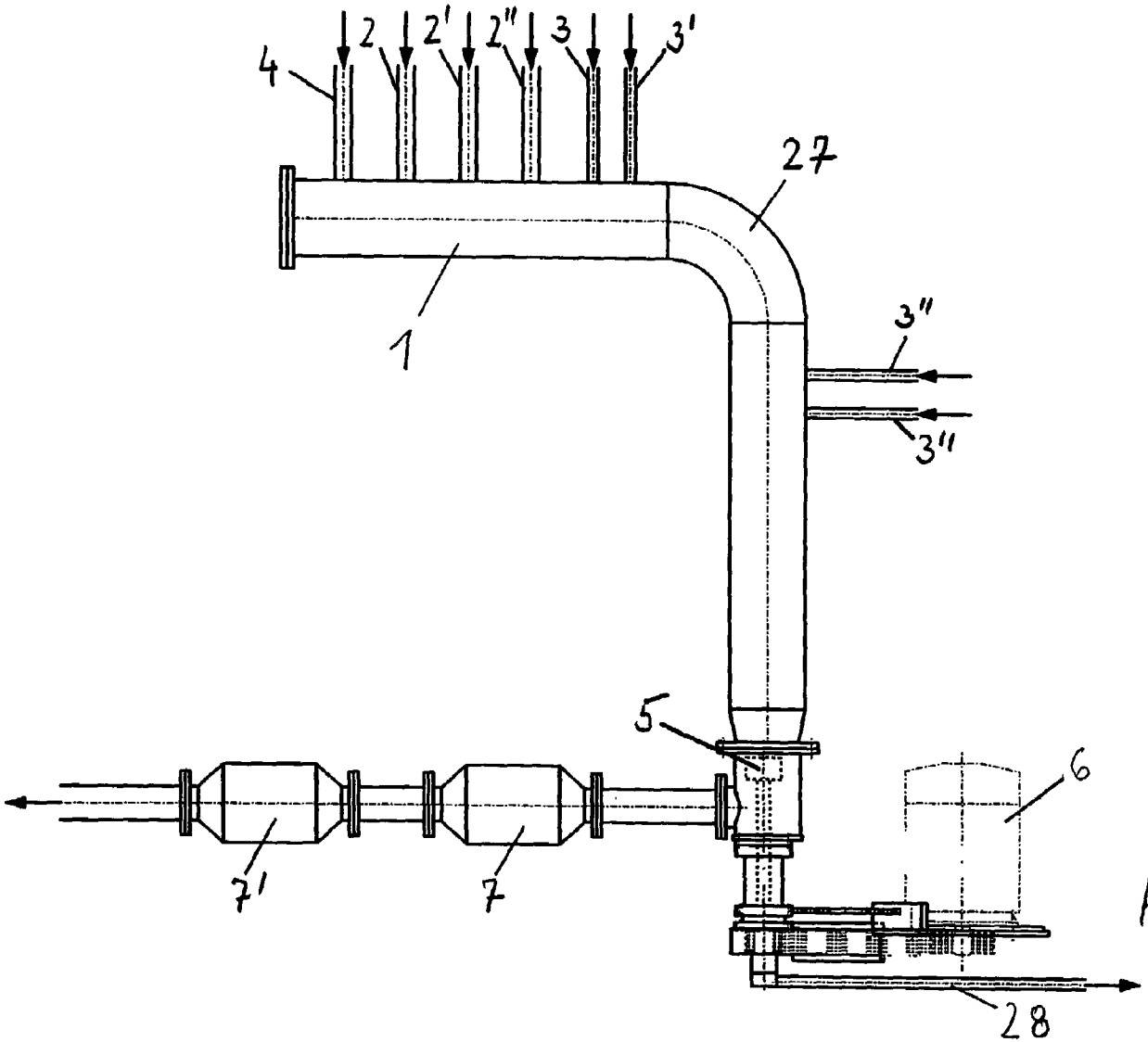

FIG. 6 shows a further variant of the invention, where preliminary mixing in the mixing pipe 1 and actual blending of all liquid flows by the degassing rotor 5 are separated by a deflection baffle 27. The mixing pipe 1, into which dilution water 4 and feed pipes 2, 2', 2" for individual pulp components discharge, has a deflection baffle 27. This figure also shows an example of feed pipes 3" for further additives after the deflection baffle 27 and shortly before the degassing rotor 5, which arrangement provides favourable distribution of the individual substances.

The invention avoids the need for large degassing tanks, which leads in turn to considerable savings in investment. Thus, a "short flow" concept can be implemented by simple and low-cost means.

The invention claimed is:

1. A process for blending diverse liquid flows in an approach system to a device for distributing a pulp suspension in a paper making machine, wherein each of at least two of the diverse liquid flows contains gas, comprising merging the diverse liquid flows followed by blending and degassing the merged diverse liquid flows substantially simultaneously with a degassing rotor.

2. The process according to claim 1, wherein the diverse liquid flows include a respective at least two flows from the group of flows containing virgin pulp, recycled fibers, and broke.

3. The process of claim 2, wherein the diverse flows include at least one flow containing a process additive.

4. The process of claim 1, wherein the diverse liquid flows include at least one flow containing pulp and at least one flow containing a process additive.

5. The process of claim 1, wherein white water from the paper machine is blended into the diverse liquid flows before degassing.

6. The process of claim 5, wherein all the white water from the paper machine is blended into the diverse liquid flows before degassing.

7. The process of claim 1, wherein the blended and degassed liquids form a suspension that is fed to a storage tank.

8. The process of claim 1, wherein the blended and degassed liquids form a suspension, and a pump delivers the suspension to the device for distributing a pulp suspension in a paper making machine.

9. The process of claim 1, wherein the blended and degassed liquids form a suspension, and at least one characteristic value of the suspension is measured.

10. The process of claim 9, wherein the characteristic value is consistency.

11. The process of claim 10, wherein dilution water is added to the suspension commensurate with the value of the measured consistency.

12. The process of claim 11, wherein the dilution water is white water from the paper machine.

13. The process of claim 1, wherein the diverse liquid flows include a respective at least three flows from the group of flows containing virgin pulp, recycled fibers, broke, and process additive; white water liquid from the paper machine is blended as a diluent into the diverse liquid flows before degassing, whereby the blended and degassed liquids form a suspension; and a pump delivers the suspension to the device for distributing a pulp suspension in a paper making machine.

14. The process of claim 13, wherein at least one characteristic value of the suspension is measured.

15. The process of claim 14, wherein the characteristic value is consistency and said diluent is added to the suspension commensurate with the value of the measured consistency.

* * * * *